United States Patent [19]

Hagemeister

[11] Patent Number: 4,595,180

[45] Date of Patent: Jun. 17, 1986

[54] SPRING ASSEMBLY

[75] Inventor: Robert C. Hagemeister, Boston, Mass.

[73] Assignee: Webster Spring Co. Inc., Oxford, Mass.

[21] Appl. No.: 657,982

[22] Filed: Oct. 5, 1984

[51] Int. Cl.[4] ..... A47C 23/04

[52] U.S. Cl. ..... 267/103; 5/255

[58] Field of Search ..... 267/90, 89, 96, 97, 267/103, 105, 110, 107; 5/247, 255, 260, 264 B, 267, 275, 476

[56] References Cited

U.S. PATENT DOCUMENTS 3,286,281 11/1966 Slominski ..... 5/247

4,101,992 7/1978 Levine et al. ..... 5/260

4,452,438 6/1984 Hancock et al. ..... 267/103

*Primary Examiner*—Duane A. Reger

*Assistant Examiner*—Robert J. Oberleitner

*Attorney, Agent, or Firm*—Robert T. Gammons

[57] ABSTRACT

A spring assembly wherein there are a plurality of spring members disposed in transversely and longitudinally-spaced relation between a rectangular base frame and a rectangular grid frame and secured thereto and wherein certain of the springs are positioned at the corners and so configured that pressure brought to bear on the grid frame bends the spring units outwardly relative to the corners to impart tension to the border wire.

5 Claims, 10 Drawing Figures

SPRING ASSEMBLY

BACKGROUND OF THE INVENTION

One of the problems with a spring assembly of the kind wherein a plurality of spring elements are positioned in transversely and longitudinally-spaced relation to each other between a rigid base frame and a rigid grid frame comprising a border wire and transversely and longitudinally-extending grid wires connected at their ends to the border wire and at their crossings to each other is that pressure brought to bear on the grid frame tends to bend the border wires downwardly so that the border wire sags. In order to minimize this, bent wire reinforcements are sometimes used to support the border wire relative to the base frame. Adding such reinforcing wires requires added operations in manufacture and increases the cost without materially improving the structure. It is the purpose of this invention to employ the unique characteristics of the bent wire spring units disclosed in my pending application in such a way as to impart tension to the border wire, hence, to prevent sagging without interposing reinforcing springs along the sides and ends.

SUMMARY OF THE INVENTION

As herein illustrated, the invention comprises a rigid rectangular base frame comprising spaced, parallel sides and ends, a rigid grid frame comprising a rectangular border wire and transversely and longitudinally-crossing grid wires attached at their ends to the border wire and at their crossings to each other and springs interposed between the base frame and grid frame including springs at the four corners structured when pressure is brought to bear on the grid frame to apply tension to the border wire in the plane of the grid frame and in directions bisecting the angles at the corners. The springs at the corners are bent wire springs and are secured at their lower ends to the base frame and at their upper ends to the border wire of the grid frame. The bent wire springs have upper and lower attaching members and a pair of side members, said side members being transversely symmetrical from side to side and asymmetrical from front to back so that pressure brought to bear on the upper ends tends to bend the springs in one direction as opposed to the other and in accordance with the invention, the springs are positioned at the corners so that the sides toward which the springs tend to bias face outwardly. The upper attaching elements of the springs comprise a straight length of wire having at its opposite ends diverging lengths of wire diverging at angles to the straight length of wire such that when the spring is placed astride a corner of the assembly with the straight length of wire diagonal to the corner, the diverging lengths of wire parallel the sides and ends of the border wire at the corner. The side members comprise first legs extending downwardly and forwardly relative to the upper attaching member toward each other and the second leg members extending upwardly and rearwardly relative to the lower attaching member away from each other. The first legs are disposed forwardly of the second legs.

The invention will now be described in greater detail with reference to the accompanying drawings, wherein.

Figure 1:
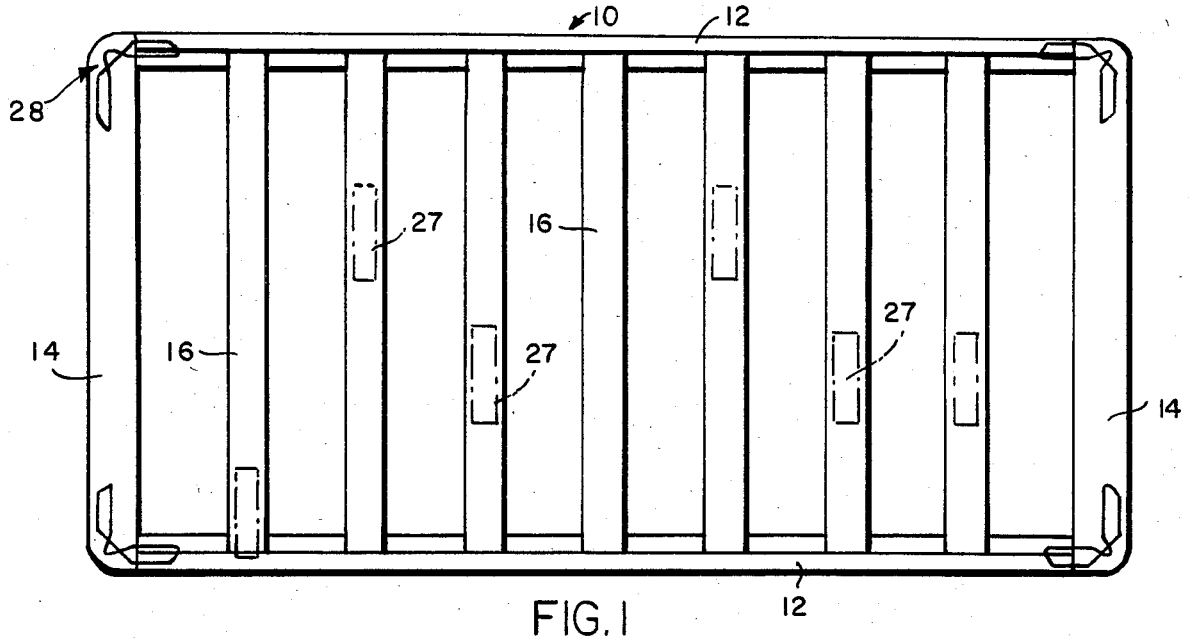
FIG. 1 is a plan view of a rigid, rectangular base frame showing the spring units of this invention positioned at the four corners thereof.

Referring to the drawings, FIG. 1, there is shown a rigid, rectangular base frame 10 comprising spaced, parallel sides 12-12 and spaced, parallel ends 14-14 connected at their ends to the spaced, parallel sides 12-12 and a plurality of longitudinally-spaced, parallel, transversely-extending support bars 16 secured at their ends to the sides 12-12.

Figure 2:
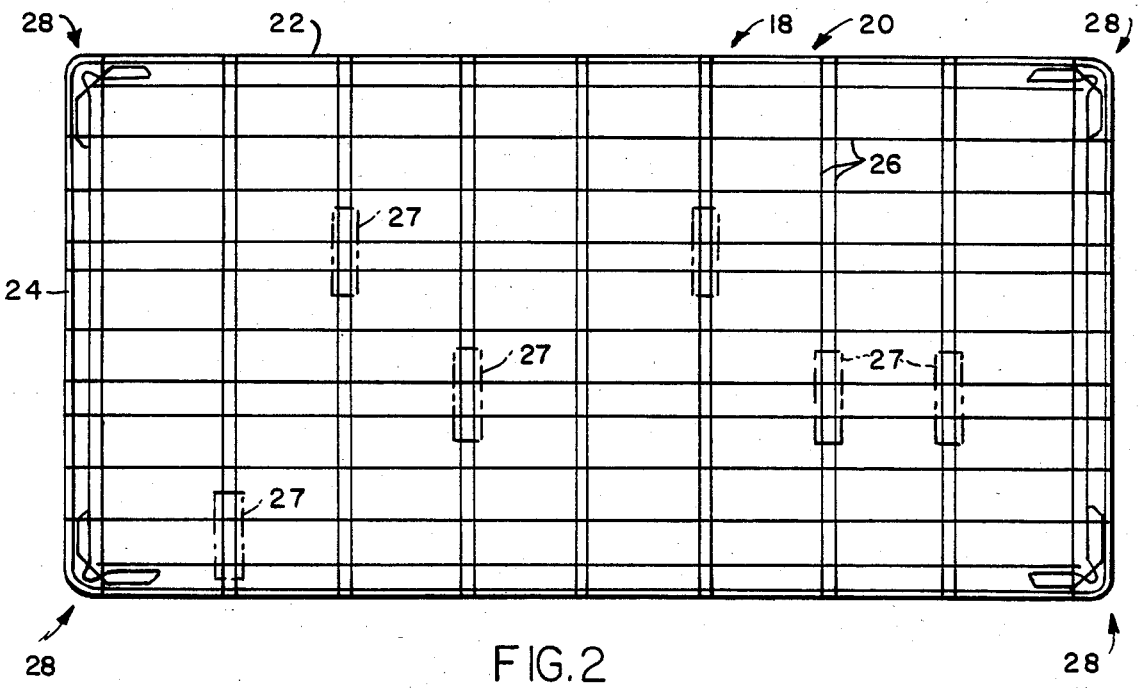
FIG. 2 is a plan view of a rectangular grid frame comprising a border wire and longitudinally and transversely-spaced grid wires attached thereto and to each other at their crossing with the spring units of this invention positioned at the four corners thereof.

FIG. 2 shows a grid frame 18 comprising a border wire 20 having spaced, parallel sides 22-22 and ends 24-24 and a plurality of longitudinally and transversely-extending grid wires 26 secured at their ends to the sides and ends of the border wire and to each other at their crossings.

In accordance with conventional practice, the grid frame 18 is held in spaced, parallel relation to the base frame 10 by a plurality of spring units of suitable kind, as indicated generally by the reference character 27 disposed in transversely-spaced relation to each other with their lower ends secured to the support bars 16 and their upper ends secured to the grid wires 26. The spring units 27 may be coil springs or bent wire springs or a combination thereof.

Figure 3:
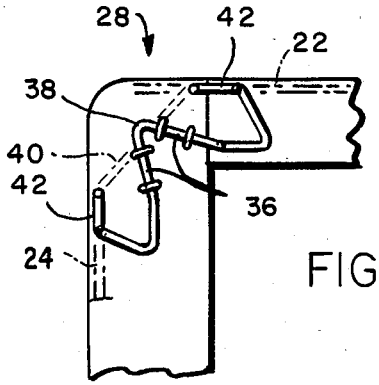
FIG. 3 is an enlarged plan view at the corner of the base frame showing the attaching of the lower end of a spring unit thereto.
Figure 4:
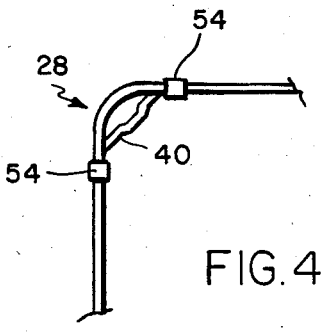
FIG. 4 is an enlarged plan view of the grid frame at a corner showing the attachment of the upper end of the spring unit thereto.

In accordance with this invention, bent wire spring units 28 are positioned at the four corners of the composite structure with their lower ends secured to the base frame and their upper ends secured to the border wire, as will now be more specifically described with references to FIGS. 3 and 4.

These bent wire spring units 28 take several forms, as disclosed in FIGS. 5 to 10.

The bent wire spring units in the several forms illustrated have in common symmetry in one direction that is, transversely from one side to the other and asymmetry in a direction at right angles thereto that is, from front to back such that when pressure is brought to bear on the upper end of the spring unit, as indicated by the arrow A, it tends to bias or tilt in its asymmetrical dimension in a direction forwardly as indicated by the arrow B with respect to its lower end. This tendency to tilt due to the asymmetrical configuration of the spring unit is employed herein by positioning the spring units at the four corners of the assembly and securing the lower ends to the base frame and the upper ends to the border wire so that pressure brought to bear on the grid frame at the corners tends to impart tension to the border wire along its sides and ends, thus to counteract any tendency for the border wire to sag.

Figure 5:
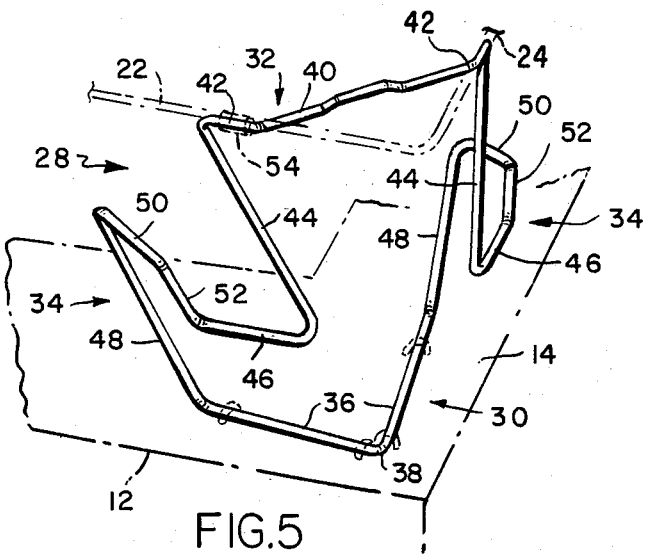
FIG. 5 is a perspective view of one form of corner spring.
Figure 6:
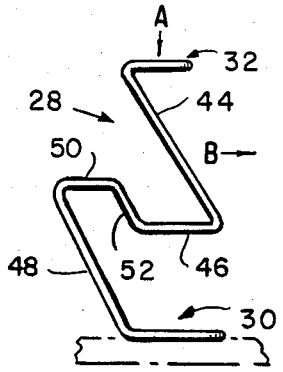
FIG. 6 is a side elevation of the spring shown in FIG. 5.

Referring specifically to FIGS. 5 and 6, the spring unit 28 in one form comprises a lower portion 30, an upper portion 32 and side portions 34-34 of bent wire construction which support the upper portion 32 for yielding movement toward the lower portion 30. The lower portion 30 comprises angularly-disposed legs 36-36 integrally joined at their forward ends at 38. The upper portion 32 comprises a substantially straight portion 40, at the opposite ends of which there are rearwardly-diverging portions 42-42. The side portions comprise legs 44 connected at their upper ends to the rear ends of the portions 42-42, at the lower ends of which there are laterally-extending arms 46-46. The side portions also include upwardly-extending legs 48-48 connected at their lower ends to the rear ends of the legs 36-36 provided with horizontal, forwardly-extending arms 50-50. The arms 46-46 and 50-50 are connected by legs 52-52. The legs 44-44 extend forwardly relative to the lower part and toward each other. The legs 48-48 extend upwardly and away from each other. The arms 46-46 and 50-50 are horizontal and the legs 52-52 diverge and are substantially parallel to the legs 48-48. Pressure brought to bear on the portion 40 at the top will tilt the top forwardly relative to the bottom.

The structure thus described is disposed at the corner of the spring assembly as shown in FIG. 3 with its lower end attached to the base frame and so oriented that the divergent parts 42-42 at the upper end parallel the border wire, FIGS. 3 & 4. The divergent parts 42-42 are secured to the border wire by clips 54-54, FIG. 4. As thus positioned, the upper part 40 extends diagonally of the corner and the apex 38 of the converging parts 36-36 at the bottom is disposed toward the corner. Pressure brought to bear on the grid frame tends to tilt the top of the spring unit outwardly relative to the bottom and thus impart tension to the border wire along its sides and ends.

The bent wire spring units disclosed in FIGS. 7, 8, 9 and 10 may optionally be used in lieu of that shown in FIGS. 5 and 6 to achieve the same purpose, to wit, the tensioning of the border wire when pressure is brought to bear on the grid frame.

Figure 7:
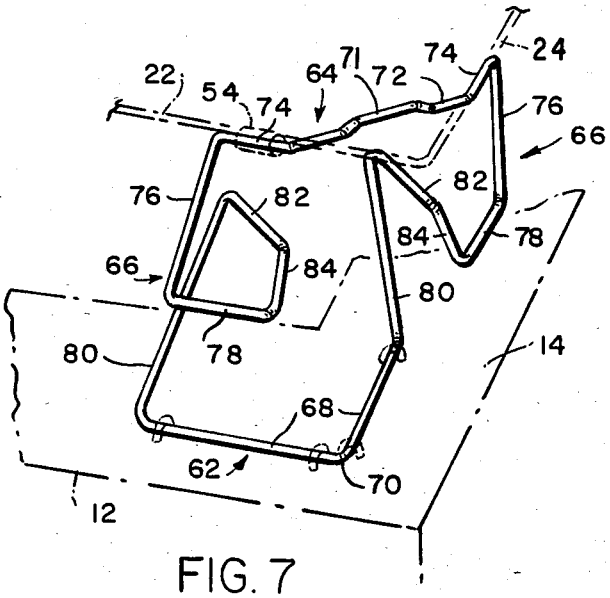
FIG. 7 is a perspective view of another form of corner spring.
Figure 8:
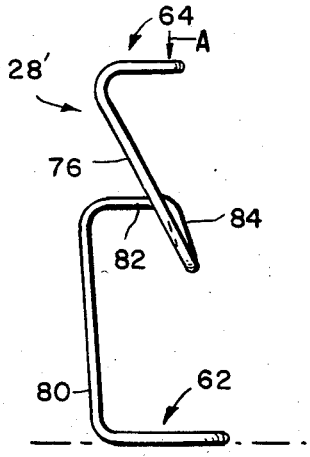
FIG. 8 is a side elevation of the spring shown in FIG. 7.

Referring to FIGS. 7 and 8, the bent wire spring unit 28' comprises a lower part 62, an upper part 64 and side parts 66-66. The lower part 62 comprises diverging parts 68-68 integrally connected at their forward ends at 70. The upper part 64 comprises a straight length 72 at the opposite ends of which there are diverging parts 74-74. The side parts 66-66 comprise legs 76-76 connected at their upper ends to the rear ends of the parts 74-74 and arms 78-78 connected to their lower ends and legs 80-80 extending upwardly from the rear ends of the parts 68-68 provided with arms 82-82 at their upper ends. The arms 78-78 and 82-82 are connected by legs 84-84. The legs 76-76 extend downwardly and forwardly away from each other. The legs 80-80 extend upwardly substantially perpendicularly and toward each other. The arms 78-78 and 82-82 are substantially horizontal and at right angles to each other and the legs 84-84 are parallel to the legs 80-80.

Figure 9:
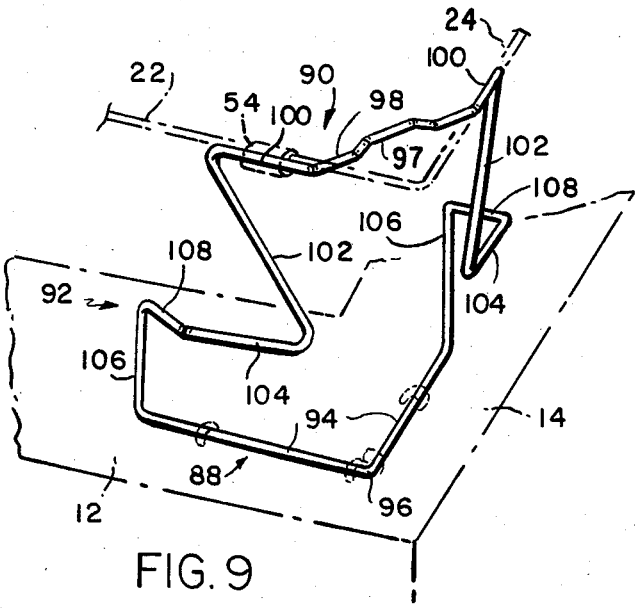
FIG. 9 is a perspective view of still another form of corner spring.
Figure 10:
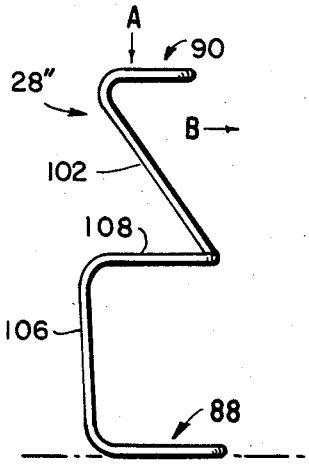
FIG. 10 is a side elevation of the spring shown in FIG. 9.

The bent wire spring unit 28" shown in FIGS. 9 and 10 comprises a lower part 88, an upper part 90 and side parts 92-92. The lower part 88 comprises diverging arms 94-94 integrally connected at their forward ends at 96. The upper part 90 comprises straight portions 98-98, at the ends of which there are diverging parts 100-100. The side parts 92-92 comprise downwardly-extending legs 102-102 integrally connected at their upper ends to the rear ends of the parts 100-100, at the lower ends of which there are arms 104-104 and upwardly-extending legs 106-106 connected at their lower ends to the rear ends of the parts 94-94 and arms 108-108 at their upper ends. The arms 104-104 and 108-108 are connected to each other. The legs 102-102 extend downwardly, forwardly and toward each other and the legs 106-106 extend upwardly nearly perpendicularly and away from each other. The arms 104-104 and 108-108 are at right angles to each other and substantially horizontal.

In each of the forms of the invention illustrated, the lower ends of the spring units are attached to the sides and ends of the base frame at the corners by staples and are attached at their upper ends to the grid wire by crimped clips 54, FIGS. 3 and 4.

As herein illustrated, spring units at the corners are so structured as to impart tension to the sides and ends of the border wire. The spring units interposed between the base frame and grid frame longitudinally and transversely thereof intermediate the spring units at the corners may be of any desired configuration, either the same as that described in FIGS. 5 and 10 or of some other configuration of the bent wire type or the coiled wire type.

It should be understood that the present disclosure is for the purpose of illustration only and includes all modifications or improvements which fall within the scope of the appended claims.

What is claimed is:

1. A spring assembly comprising a rigid rectangular base frame comprising spaced, parallel sides and ends, a grid frame comprising a rectangular border wire and trasnversely and longitudinally-crossing grid wires attached to the border wire at their ends and to each other at their crossing and spring means distributed in longitudinally and transversely-spaced relation between the border wire and the base frame and at corners between the border wire and the base frame, supporting said grid frame in spaced, parallel relation with the base frame and connecting the same, characterized in that the spring means at the corners comprise upper and lower attaching members and a pair of transversely-spaced side members, said transversely-spaced side members being symmetrical from side to side and asymmetrical from front to back, said upper attaching member comprising a first length of wire such as to span the border wire along the sides at the corner of the grid, second lengths of wire connected at one end to the opposite ends of the first length of wire and disposed at an oblique angle thereto such as to be parallel to the base frame at the corners of the border wire, said lower attaching member comprising integrally-connected third lengths of wire disposed at substantially right angles to each other substantially parallel to the respective sides at the corners of the base frame and said side members each comprising upper and lower legs, said upper legs being connected at their upper ends to the distal ends of the second length and extending downwardly and forwardly relative to the first length of wire more then half the distance between the grid frame and the base frame, said lower legs being connected at their lower ends to the distal ends of the third wires and extending upwardly and rearwardly relative to the third legs a distance more than half the distance between the base frame and the grid frame and means connecting the lower ends of the upper legs to the upper ends of the lower legs such that the lower ends of the upper legs are suspended forwardly of the upper ends of the lower legs so that pressure brought to bear on the upper attaching element cants the upper legs forwardly relative to the lower legs.

2. A spring assembly according to claim 1 wherein the spring means at the corners are bent wire springs.

3. A spring assembly according to claim 1 wherein the spring means at the corners are secured at their lower ends to the base frame and at their upper ends to the border wire of the grid frame.

4. A spring assembly according to claim 1 wherein said side members comprise first legs extending downwardly and forwardly relative to the upper attaching member and toward each other and second leg members extending upwardly and rearwardly relative to the lower attaching member and away from each other.

5. A spring assembly according to claim 4 wherein the first legs are disposed forwardly of the second legs.

* * * * *